United States Patent [19]

Wiesel

[11] Patent Number: 4,479,775

[45] Date of Patent: Oct. 30, 1984

[54] VANE STRUCTURE BURNER FOR IMPROVED AIR-FUEL COMBUSTION

[75] Inventor: Yitzhak Wiesel, Motza Ilit, Israel

[73] Assignee: Sivan Development and Implementation of Technological Systems Ltd., Tel Aviv, Israel

[21] Appl. No.: 418,419

[22] Filed: Sep. 15, 1982

[30] Foreign Application Priority Data

Dec. 4, 1981 [IL] Israel ..... 64452

[51] Int. Cl.[3] ..... F23D 15/04

[52] U.S. Cl. ..... 431/353; 431/181; 431/182; 431/183; 239/403; 239/406

[58] Field of Search ..... 431/181, 182, 183, 353; 239/403, 405, 406, 416.5, 424, 499, 418

[56] References Cited

U.S. PATENT DOCUMENTS

| | | | |
|---|---|---|---|
| 1,722,253 | 7/1929 | Sherwood | 431/183 |
| 1,959,521 | 5/1934 | Bolt | 431/183 |
| 2,105,546 | 1/1938 | McDonald | 431/182 |
| 3,308,870 | 3/1967 | Rex, Jr. | 431/183 |
| 4,082,495 | 4/1978 | Lefebure | 431/183 |

FOREIGN PATENT DOCUMENTS

| | | | |
|---|---|---|---|
| 0853325 | 10/1952 | Fed. Rep. of Germany | 239/406 |
| 0176318 | 8/1961 | Sweden | 239/406 |

*Primary Examiner*—Samuel Scott
*Assistant Examiner*—Helen Ann Oda
*Attorney, Agent, or Firm*—Toren, McGeady and Stanger

[57] ABSTRACT

An improved burner for attaining an improved combustion of a fuel-air mixture includes a plurality of vanes extending generally longitudinally of and disposed about an axis of the flow of the air-fuel mixture, each of the vanes having a first and a second end joined by first and second longitudinal edges. The first ends being contiguously arranged to extend along the circumference of a circle coaxial with the axis, the first edges defining a cylindrical surface coaxial with the main axis, and the second edges defining a conical surface coaxial with the axis. The vanes being interconnected at their first ends. The vane structure being confined in a cylindrical structure defining at the one end an annular opening through which compressed air is introduced, with a fuel nozzle being provided at the center of the same end. The nozzle being located at the end of the vane structure where the vanes substantially meet at the center of the structure. The other end of the cylinder being closed at the annular space, and defining a central opening for the exit of the fuel and air mixture, where the combustion of the mixture takes place. The intimate mixture of the air and the fuel being the result of the intermixing of the air with the atomized fuel, the air entering through the opening of the vane structure.

6 Claims, 5 Drawing Figures tc°
800
700
600
500
0.8
0.9
1.0
1.1
1.2
1.3
1.4
λ
1
2

η
0.7
0.6
0.5
0.4
0.3
0.8
0.9
1.0
1.1
1.2
1.3
1.4
λ
1
2

VANE STRUCTURE BURNER FOR IMPROVED AIR-FUEL COMBUSTION

FIELD OF THE INVENTION

The invention relates to improved burners, and especially burners for use in industry.

BACKGROUND OF THE INVENTION

The optimum utilization of fuels by industrial burners is of considerable economical importance. Furthermore, burners which utilize the fuel with a high degree of efficiency tend to maintain their performance over prolonged periods of time. A good utilization of the fuel results in a blue flame, and if the combustion is a good one, the size of the flame is rather small, making possible the construction of burning chambers of reduced size for a given caloric output.

Hitherto many attempts have been made to obtain a good utilization of heavy fossil fuels, but with only very limited success. The conventional burners used nowadays in industry do not give a satisfactory performance. Even a rather small increase of the utilization of fuels, and thus of overall yield, has a considerable economical significance.

SUMMARY OF THE INVENTION

The invention provides a novel burner provided with means resulting in a very thorough and intimate fuel/air mixture, which undergoes nearly complete combustion in a comparatively small space, resulting in a high thermal yield and in a good fuel utilization.

The novel burner is constructed so as to provide a rapid swirling of the air/fuel mixture, resulting in a break-up of larger drops and in a thorough mixing of the air with the fuel, and in an efficient combustion of the said fuel.

The novel device comprises a plurality of bent vanes, which are arranged in an arrangement opposite to that of conventional vane-type arrangements, and which are furthermore surrounded by an annular space adapted to introduce air into the vane-space, enhancing the fuel/air admixture and resulting in the desired high caloric yield of the burner.

Although any reasonable number of bent vanes can be used, such as from about 4 to 10 vanes, best results were obtained with a six-vane structure which is illustrated in greater detail in the following description, this being only illustrative of the present invention.

The device according to the invention comprises a structure of a plurality of bent vanes, meeting about the center of the structure adjacent the inlet nozzle of the fuel, said structure being closed by a circular plate provided with a central inlet for the fuel to the nozzle, said structure being surrounded by a cylindrical sleeve defining a predetermined annular space between said sleeve and between the space defined by said circular plate which corresponds essentially with the larger diameter of the vane structure, said annular space defining the inlet for air coming from a suitable source, like a compressor, the said annular space being closed at its lower end, the flame being located at the lower end of said structure.

The vane structure is essentially a simple one and this can be obtained by cutting a cylinder into a plurality of rectangular members and bending same so as to nearly meet at a given point. The vane structure comprises a plurality of vanes extending generally longitudinally of and disposed about the axis of the structure, each of the vanes having first and second ends joined by first and second longitudinal edges, the first ends being contiguously arranged to extend along the circumference of a circle coaxial with said axis and said second edges defining a conical surface coaxial with said axis, the vanes being interconnected at their first ends, the direction of the vane structure being such that the vanes meet (and are essentially closed) at the location of the burner-nozzle fuel entrance, and open at the other end, an annular cylindrical sleeve surrounding said vane structure at a given distance from same.

The performance of the novel burner is as follows: fuel is introduced under pressure through the central nozzle of the burner, while air is introduced under pressure via the annular opening between the said sleeve and the vane structure, in the direction of the axial fuel flow, said air being given a swirling movement by said vanes, resulting in the intimate admixture of fuel and air, homogenizing said mixture, and resulting in a high caloric yield and overall utilization of the fuel by the burner. The exit of the fuel/air mixture is via the open end of the vane structure, farthest from the fuel entrance, and the resulting flame is blue, non smoking and of comparatively small length.

The invention is illustrated with reference to the enclosed schematical drawings, not according to scale, in which.

Figure 1:
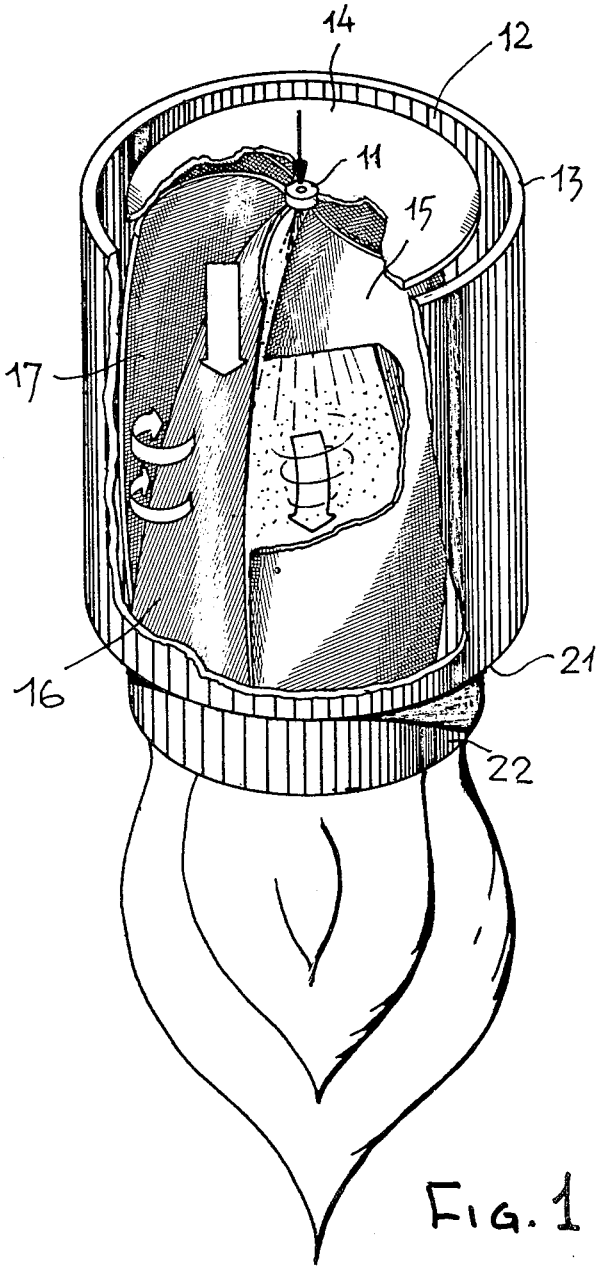
FIG. 1 is a perspective view of a burner of the invention in partial section.

As shown in FIG. 1, fuel is injected under pressure via a conduit (not shown) into and via nozzle 11, while air from a compressor flows through the annular opening 12 between exterior sleeve 13 and circular plate 14. Beyond the plate 14 there is provided a 6-vane structure, comprising six vanes 15 to 20, as shown in the following Figures. These form a funnellike structure with six openings towards the annular space 12, through which the air enters the central space of the structure, where a thorough mixing of the fuel coming from nozzle 11 with the air coming from the compressor and entering via annular space 12 is attained. The direction of flow of the compressed air is indicated by the arrows. The result is an intimate admixture of the fuel with the air, and this fuel-air mixture leaves through the circular opening 21 defined by the cylinder 22, which is closed towards cylinder 13 by a member 23 not shown in FIG. 1, but note FIG. 2, where said fuel-air mixture forms a flame and undergoes combustion.

It is clear that the six-vane structure is open towards the annular space defined by its outer perimeter and the cylinder 13, the compressed air flowing into the center of the structure via said six openings resulting in a flow of fuel-air towards the exit of this mixture where it undergoes combustion.

Figure 2:
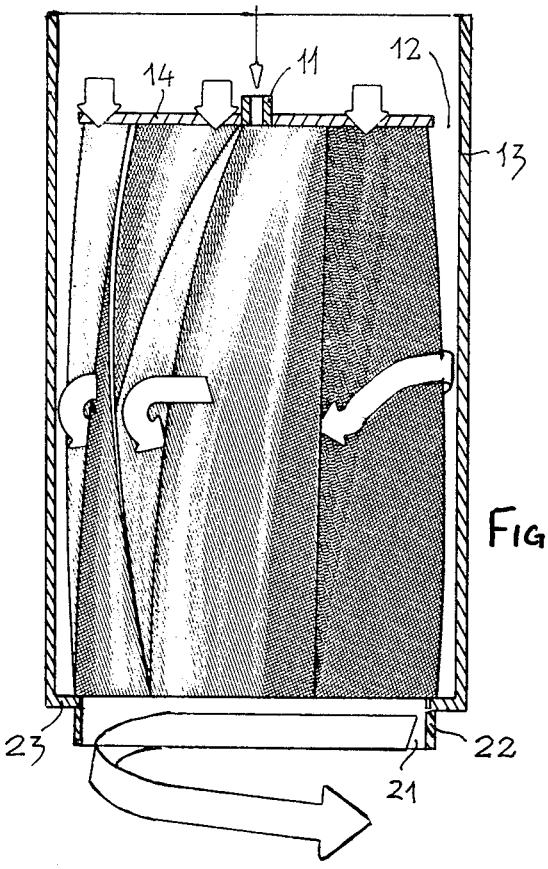
FIG. 2 is an axial section through a device shown in FIG. 1.
Figure 3:
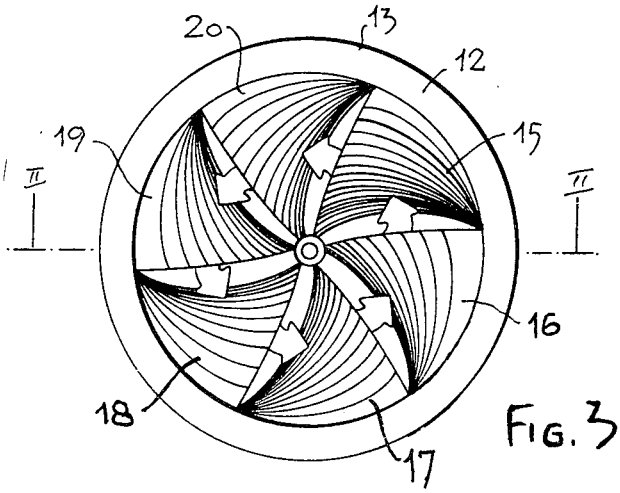
FIG. 3 is a top view, from the fuel/air exit, of the device.

The structure is further illustrated in FIGS. 2 and 3, as well as by the photographs enclosed for a better understanding of the vane structure, where the numbers indicate the same members as in FIG. 1.

The vane structure can be produced by taking a cylinder, providing 6 cuts so as to result in six rectangular sections and bending same as to substantially meet in the center of the structure, as shown in the Figures and as is clear from the photographs. The nozzle is provided at the apex defined by such meeting point, and the direction of flow of the fuel-air mixture is from this point towards the open end of the structure.

The arrangement is characterized in that the fuel flows from the "closed end" of the vane structure towards the "open end", and that the air enters via said vanes, which are open towards the cylindrical confining member, and that this flow of compressed air towards the center of the structure, and as a result of the entrainement of the stream of atomized fuel in the direction from the nozzle towards the opening at the other end of the device, results in an intimate mixture of the fuel with the air, which fuel-air mixture undergoes nearly complete combustion at the exit of the fuel air mixture from the device.

Various experimental devices were produced according to the invention and tested. A considerably improved performance and combustion efficiency was attained compared with conventional burners. A nearly complete combustion was attained, and this with a flame of considerably reduced size.

Figure 4:
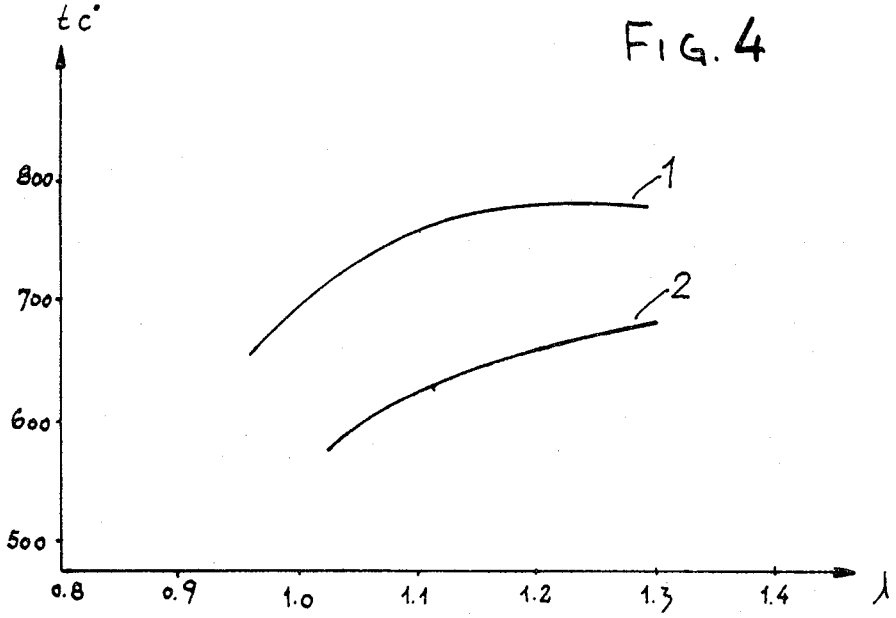
FIGS. 4 and 5 are graphical representations of temperature versus fuel/air ratio and efficiency versus fuel/air ratio.
Figure 5:
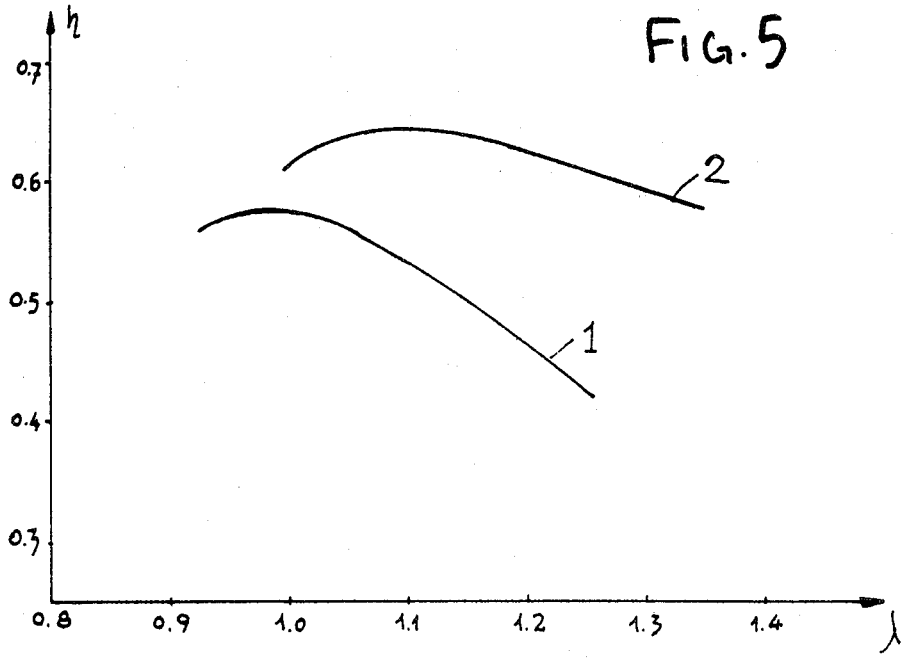

For example, a burner was tested with an oven of 120×60×60 cm. The burner used 50 kg/hour of heavy fuel and the fuel was introduced via a nozzle of 45° opening under 8 atmospheres pressure. The device was of 170 mm diameter and 200 mm length, with a 3.5 width annular space between the central core defined by the outer diameter of the vane structure and the outer cylinder. A six-vane structure was used, the vanes meeting at the fuel nozzle. Air was introduced at a rate of 50 kg/hour. The resulting flame was of blue color and the fuel underwent nearly complete combustion. The length of the flame was only about 50 percent that of a flame of the same nozzle with the same fuel and air quantity without the vane structure. The efficiency of the device is illustrated in FIGS. 4 and 5 by the enclosed graphical representation of temperature versus fuel/air ratio and efficiency versus fuel/air ratio.

It is clear that the simple and inexpensive device according to the invention results in a much improved performance of burners and in a better fuel utilization and overall efficiency. Furthermore, the performance of the burner remains constant over prolonged periods of time at this high efficiency.

I claim:

1. An improved burner for attaining an improved combustion of a fuel-air mixture comprising an elongated cylindrical sleeve (13) having a central axis and a first end and a second end extending transversely of the central axis, a circular plate (14) located within said sleeve adjacent the first end thereof and extending transversely of the central axis, said circular plate having a circular circumferential edge spaced radially inwardly from said sleeve and forming in combination with said sleeve an annular first opening, an annular plate-like member (23) located at the second end of said sleeve and connected to said sleeve and extending transversely of the central axis, said annular plate-like member extending radially inwardly from said sleeve, said annular plate-like member (23) having a radially inner edge spaced inwardly from said sleeve defining a second opening, six vanes (15–20) located within said sleeve and extending approximately in the direction of the central axis from said circular plate (14) to said annular plate-like member (23), each said vane having a first end at said circular plate (14), a second end at said plate-like member (23), a first edge extending between said first and second ends in the direction of and adjacent to the central axis of said sleeve, and a second edge extending between said first and second ends in the direction of the central axis and spaced radially outwardly from said first edge and radially inwardly from said sleeve, said vanes extending radially outwardly from the first edges to the second edges in angularly spaced relation with the space between adjacent said vanes increasing from the first edges to the second edges, said second edges of said vanes are located on a circle spaced radially inwardly from said sleeve with an axially extending annular space located between said second edges and said sleeve and extending from said annular first opening to said annular plate-like member (23), the second edges of adjacent said vanes defining openings in communication with said annular space, a nozzle (11) located on said circular plate (14) coaxial with the central axis of said sleeve for supplying fuel through said circular plate into said sleeve in the area of said first edges of said vanes, said second ends of adjacent said vanes forming outlet openings from the space between adjacent said vanes to the second opening from said sleeve, whereby air is introduced through said annular first opening and the fuel introduced through said nozzle (11) effect an intimate mixture of the air and fuel within the axial area of said vanes with the fuel-air mixture exiting from said sleeve and undergoing combustion at the second opening from said sleeve.

2. An improved burner, as set forth in claim 1, wherein said vanes are curved in the plane extending transversely of the central axis, the first edges of said vanes defining a cylinder coaxial with said central axis and the second edges of said vanes defining a conical surface coaxial with said central axis.

3. An improved burner, as set forth in claim 1, wherein the ratio of the diameter of said sleeve to the length of said sleeve is in the range of 1:2 to 1.5:1.

4. An improved burner, as set forth in claim 1, wherein said annular space has a radial dimension in the range of about 10 to 25% of the diameter extending from said central axis to said second edges of said vanes.

5. An improved burner, as set forth in claim 1, wherein a cylinder (22) open at the ends thereof is connected at one end to the radially inner end of said plate-like member (23) and extends coaxially with said central axis outwardly away from said second opening.

6. An improved burner for attaining an improved combustion of a fuel-air mixture comprising a plurality of vanes extending generally longitudinally of and disposed about an axis of the flow of the air-fuel mixture, each of the said vanes having a first and a second end joined by a first and a second longitudinal edge, the first ends being contiguously arranged to extend along the circumference of a circle coaxial with said axis, said first edges defining a cylindrical surface coaxial with the said axis, and said second edges defining a conical surface coaxial with said axis, the vanes being interconnected at their first ends, said vane structure being confined in a cylindrical structure defining at the first end an annular opening through which compressed air is introduced, the ratio of the diameter of cylindrical structure relative to the length of the cylindrical structure is in the range of 1:2 to 1.5:1; the annular space between the outer circumference of the vane structure and the cylindrical structure is about 10 to 25% the diameter of the vane structure, a fuel nozzle being provided at the center of first end, the said nozzle being located at the end of the vane structure where said vanes substantially meet at the center of the structure, the other end of the cylinder being closed at said annular space, and defining a central opening for the exit of said fuel and air mixture, where the combustion of the said mixture takes place; the intimate mixture of the air and the fuel being the result of the intermixing of said air with the atomized fuel, said air entering through the opening of said vane structure.

* * * * *